US005441160A

United States Patent [19]

DeWoolfson et al.

[11] Patent Number: 5,441,160

[45] Date of Patent: Aug. 15, 1995

[54] METHOD OF COLLECTING DENSIFIED COMMODITIES USING A MOBILE MULTI-COMPARTMENT COMMODITY COLLECTION AND STORAGE ASSEMBLY

[75] Inventors: Bruce H. DeWoolfson; Ken R. Powell, both of Fairfax, Va.

[73] Assignee: Environmental Products Corporation, Fairfax, Va.

[21] Appl. No.: 88,333

[22] Filed: Jul. 9, 1993

Related U.S. Application Data

[63] Continuation-in-part of Ser. No. 915,867, Jul. 20, 1992, Pat. No. 5,226,519, which is a continuation of Ser. No. 693,250, Apr. 29, 1991, abandoned.

[51] Int. Cl.[6] ..... B07C 7/04

[52] U.S. Cl. ..... 209/702; 209/930; 209/935

[58] Field of Search ..... 194/209, 213; 209/702, 209/942, 930, 935; 414/398, 467, 507; 406/1, 2, 43, 151, 156

[56] References Cited

U.S. PATENT DOCUMENTS

| | | | |
|---|---|---|---|
| 2,745,562 | 5/1956 | Vandemark et al. . | |
| 3,496,977 | 2/1970 | Gifford . | |
| 4,245,731 | 1/1981 | Herbst et al. | 194/209 |
| 4,248,389 | 2/1981 | Thompson et al. . | |
| 4,285,426 | 8/1981 | Cahill . | |
| 4,310,279 | 1/1982 | Johnston . | |
| 4,324,325 | 4/1982 | Dewoolfson . | |
| 4,345,679 | 8/1982 | DeWoolfson . | |
| 4,373,435 | 2/1983 | Grevich . | |
| 4,425,070 | 1/1984 | Howells et al. . | |
| 4,440,284 | 4/1984 | DeWoolfson . | |
| 4,469,212 | 9/1984 | DeWoolfson et al. . | |
| 4,492,295 | 1/1985 | DeWoolfson . | |
| 4,573,641 | 3/1986 | DeWoolfson et al. . | |
| 4,579,216 | 4/1986 | DeWoolfson et al. . | |
| 4,597,487 | 7/1986 | Crosby et al. | 209/930 X |
| 4,687,144 | 8/1987 | Irwin et al. . | |
| 4,703,614 | 11/1987 | Cooper et al. . | |
| 4,784,251 | 11/1988 | DeWoolfson et al. . | |
| 4,786,003 | 11/1988 | Johnson . | |
| 4,829,428 | 5/1989 | Weitzman et al. . | |
| 4,840,531 | 6/1989 | Dinneen . | |
| 4,892,259 | 1/1990 | von der Heide . | |
| 4,915,570 | 4/1990 | Rath et al. . | |
| 4,919,534 | 4/1990 | Reed . | |
| 4,923,126 | 5/1990 | Lodovico et al. . | |
| 4,949,528 | 8/1990 | Palik . | |
| 4,961,539 | 10/1990 | Deem . | |
| 4,979,866 | 12/1990 | Croy . | |
| 4,981,411 | 1/1991 | Ramsey . | |
| 4,995,765 | 2/1991 | Tokuhiro et al. | 209/930 X |
| 5,002,453 | 3/1991 | Shigehisa . | |

(List continued on next page.)

FOREIGN PATENT DOCUMENTS

| | | |
|---|---|---|
| 0082735 | 6/1983 | European Pat. Off. . |
| A0500004 | 8/1992 | European Pat. Off. . |
| A9203360 | 3/1992 | France . |
| 1947729 | 4/1971 | Germany . |
| A3510700 | 9/1986 | Germany . |
| A4022124 | 1/1992 | Germany . |
| U9216358 | 2/1993 | Germany . |
| WO88/07244 | 9/1988 | WIPO . |

OTHER PUBLICATIONS

European Search Report dated Oct. 20, 1994 for Application No. 94106442.0.

McMahon, Jim; "Co-Collection Offers Big Advantage . . ." World Wastes, Aug. 1991.

Malloy, Michael, "Co-Collection Trucks," Waste Age, Dec. 1992.

(List continued on next page.)

*Primary Examiner*—D. Glenn Dayoan

*Attorney, Agent, or Firm*—Finnegan, Henderson, Farabow, Garrett & Dunner

[57] ABSTRACT

A method of collecting a plurality of commodities includes the steps of densifying each of the pluralities of commodities into a plurality of densified materials, collecting the plurality of densified materials into at least one of a plurality of segregated temporary storage bins, and transferring at least one of the plurality of densified materials to at least one of a plurality of segregated storage compartments on a mobile multi-compartment storage vehicle.

16 Claims, 19 Drawing Sheets

U.S. PATENT DOCUMENTS

| | | | |
|---|---|---|---|
| 5,015,142 | 5/1991 | Carson . | |
| 5,015,143 | 5/1991 | Carson . | |
| 5,024,335 | 6/1991 | Lundell . | |
| 5,028,870 | 7/1991 | Reed . | |
| 5,035,563 | 7/1991 | Mezey . | |
| 5,035,564 | 7/1991 | Matsumoto . | |
| 5,042,634 | 8/1991 | Gulmini | 194/209 |
| 5,068,835 | 11/1991 | Reed . | |
| 5,074,737 | 12/1991 | Pellegrini et al. . | |
| 5,078,567 | 1/1992 | Lombardo . | |
| 5,083,704 | 1/1992 | Rounthwaite | 209/702 X |
| 5,111,927 | 5/1992 | Schulze, Jr. | 209/930 X |
| 5,116,184 | 5/1992 | Pellegrini . | |
| 5,161,661 | 11/1992 | Hammond | 194/209 |
| 5,167,343 | 12/1992 | Winfrey et al. . | |
| 5,192,121 | 3/1993 | Stutler . | |
| 5,226,519 | 7/1993 | DeWoolfson . | |

OTHER PUBLICATIONS

Brochure entitled: "The Walinga Champion," Walinga Inc., Ontario, Canada, Mar. 1993.

Brochure entitled: "Haul-All," Haul-All Equipment Systems, Alberta, Canada, Feb. 1992.

Hi-Vac Drawing No. 30 D 3035-6-6, "HV-1619," Hi-Vac Corporation, Marietta, Ohio, Sep. 25, 1991.

NFE Drawing No. A-2137-1-00, "L.P.G. Powerhead," NFE International Ltd., Arlington Heights, Illinois, Jun. 17, 1977.

Ultra Vac Drawing No. 2-9000-251, "Model 105 with Satellite Collector Unit," Ultra Vac, Marietta, Ohio, 1971/72.

Burgiel, Jonathan et al., "Co-collection: is it a viable technique?", Resource Recycling, vol. XII, No. 6, Jun. 1993, pp. 30-37.

Apothekar, Steve, "Finding a Formula for Sucessful Recycling Coll.," Resource Recycling, vol. XI, No. 10, Oct. 1992, pp. 28-39.

"Two in One," Advertisement, Resource Recycling, vol. XII, No. 2, Feb. 1993.

"National Recycling Equipment Meets Customers' Needs with Unique Approach," New Hamp. Bus. Rev., vol. 13 No. 17, Aug. 23-Sep. 5, 1991.

Pamphlet entitled "Fast Vac: Industrial Vacuum Loaders," from Ormson Corporation (no date).

Article entitled "Super Products Stresses Innovation to Spur Growth, Boost Productivity," reprinted form Trailer/Body Builders (no date).

Pamphlet entitled "A Vacuum Loader That'll Blow Other Prices out of the Sky: Air Force," from Ormson Corporation (no date).

Pamphlet entitled "Ultra Vac Models 925, 935 Industrial Vacuum Loaders," from Ultravac; WSA, Inc. (no date).

Pamphlet entitled "Super Sucker Super Products: The World's Leading Industrial Vacuum Loader . . . " from Super Products (no date).

METHOD OF COLLECTING DENSIFIED COMMODITIES USING A MOBILE MULTI-COMPARTMENT COMMODITY COLLECTION AND STORAGE ASSEMBLY

This application is a continuation-in-part of application Ser. No. 07/915,867, filed Jul. 20, 1992, now U.S. Pat. No. 5,226,519, which is in turn a continuation of application Ser. No. 07/693,250, filed Apr. 29, 1991, abandoned, both of which are incorporated by reference herein.

BACKGROUND OF THE INVENTION

1. Field of the Invention

This invention relates to the collection and storage of recyclable commodities. More particularly, the invention relates to systems for collecting, densifying and storing used beverage containers of various types. Even more particularly, the invention relates to a method for collecting a plurality of commodities wherein the densified commodities are transferred to a mobile multi-compartment storage vehicle.

2. Description of the Related Art

In recent years, with increasing emphasis on energy conservation, the recycling of used beverage containers and other similar commodities has become an important factor in the conservation effort. More specifically, the recycling of aluminum, glass and plastic containers has proven to be energy efficient, and environmentally beneficial.

In addition, numerous jurisdictions have enacted mandatory deposit laws which require deposits on all beverage containers. Such laws create additional problems for the grocery industry, and burdens for those tasked with collecting the containers, paying the refunds, and storing the returned commodities. A number of machines have been developed in the prior art for encouraging the recovery and recycling of beverage containers. For example, Applicant's assignee is the owner of the U.S. Pat. Nos. 4,440,284; 4,573,641; 4,492,295; and 4,784,251. All of these patents relate to machines and systems for automated redemption of used beverage containers. While much progress has been made in the development of efficient systems for encouraging and effecting recycling of containers, a number of problems still remain in the prior art. In particular, in those areas where reverse vending machines are used to collect and store such containers, retail store operators typically must remove the crushed or densified commodities from the machine and store them for later pickup. This creates storage problems for the retailer and uses up otherwise valuable retail or storage space.

In addition, in some jurisdictions, retailers are obligated to accept returned containers. Thus, if a reverse vending machine is inoperable, repairs must be made rapidly in order to avoid disruption of the retailer's operation to manually sort and store containers.

Another problem experienced with prior art systems is the requirement for the retailer or other service agency to frequently add money to machines which pay deposit refunds or other monetary compensation for returned containers.

Another problem has been experienced with removal of the recycled containers from the retailer's facility. A vehicle is required to collect and store the recycled material, and to haul it to a recycling center. None of the vehicles currently in use are adequate for this purpose. For example, existing vehicles have trailers with only one or a limited number of storage compartments inadequate to store multiple varieties of recycled material (e.g., green glass, clear glass, clear PET, colored PET, aluminum, and so on) in separate segregated compartments. Moreover, existing vehicles have inadequate means for loading the material into the storage compartments. Finally, existing vehicles are difficult to unload at the recycling center.

Accordingly it is an object of the present invention to efficiently collect, densify and store large quantities of post consumer recyclable commodities with a minimum of service requirements.

It is a further object of the present invention to reduce the burdens of maintaining adequate supplies of coins or currency in the collection stations of a commodity collection and storage system.

It is an additional object of the present invention to reduce the incidence of break-in of the collection stations of a commodity collection and storage system by utilizing an alternative to currency or coins.

A further object of the invention is to provide a commodity collection and storage system in which the collection stations can automatically indicate when repairs are needed to a central control facility.

Another object of the invention is to provide a method for collecting a plurality of commodities in a quick and efficient manner.

Additional objects and advantages of the invention will be apparent from the description which follows, or may be learned by practice of the invention.

SUMMARY OF THE INVENTION

To achieve the foregoing objects and advantages, and in accordance with the purposes of the invention as embodied and broadly described herein, the method of collecting a plurality of commodities of the present invention comprises the steps of densifying each of the pluralities of commodities into a plurality of densified materials, collecting the plurality of densified materials into at least one of a plurality of segregated temporary storage bins, and transferring at least one of the plurality of densified materials to at least one of a plurality of segregated storage compartments on a mobile multi-compartment storage vehicle.

BRIEF DESCRIPTION OF THE DRAWINGS

The accompanying drawings, which are incorporated in and constitute a part of the specification, illustrate the presently preferred embodiments of the invention and, together with the description, serve to explain the principles of the invention.

DESCRIPTION OF THE PREFERRED EMBODIMENT

Reference will now be made/in detail to the present preferred embodiments of the invention, as illustrated in the accompanying drawings.

The present invention is a multiple use commodity collection and storage system, a mobile multi-compartment commodity collection and storage assembly, and a method for collecting a plurality of commodities.

In accordance with the invention, the system comprises a plurality of remotely located collection stations, each receiving a plurality of different predetermined post consumer recyclable commodities. In accordance with the invention, each station includes a consumer selectable insert port for receiving each different predetermined type of commodity, pre-selection means associated with each insert port for automatically verifying that an inserted commodity is of the predetermined type; microprocessor means for storing data corresponding to the commodities verified by the pre-selection means; means for densifying the commodities received in each insert port and verified by the pre-selection means to be of the predetermined type; bulk storage means including a segregated storage area for separately storing each predetermined type of densified commodity; transfer means for automatically transferring each predetermined type of densified commodity from the densifying means to the corresponding segregated storage area in the bulk storage means and continuously maintaining the segregation of the commodity types during the transfer; and means for issuing at least one token in response to the receipt of a predetermined commodity.

In accordance with the invention, the method of collecting a plurality of commodities comprises the steps of densifying each of the plurality of commodities into a plurality of densified materials, collecting the plurality of densified materials into at least one of a plurality of segregated temporary storage bins, and transferring at least one of the plurality of densified materials to at least one of a plurality of segregated storage compartments on a mobile multi-compartment storage vehicle.

Figure 1:
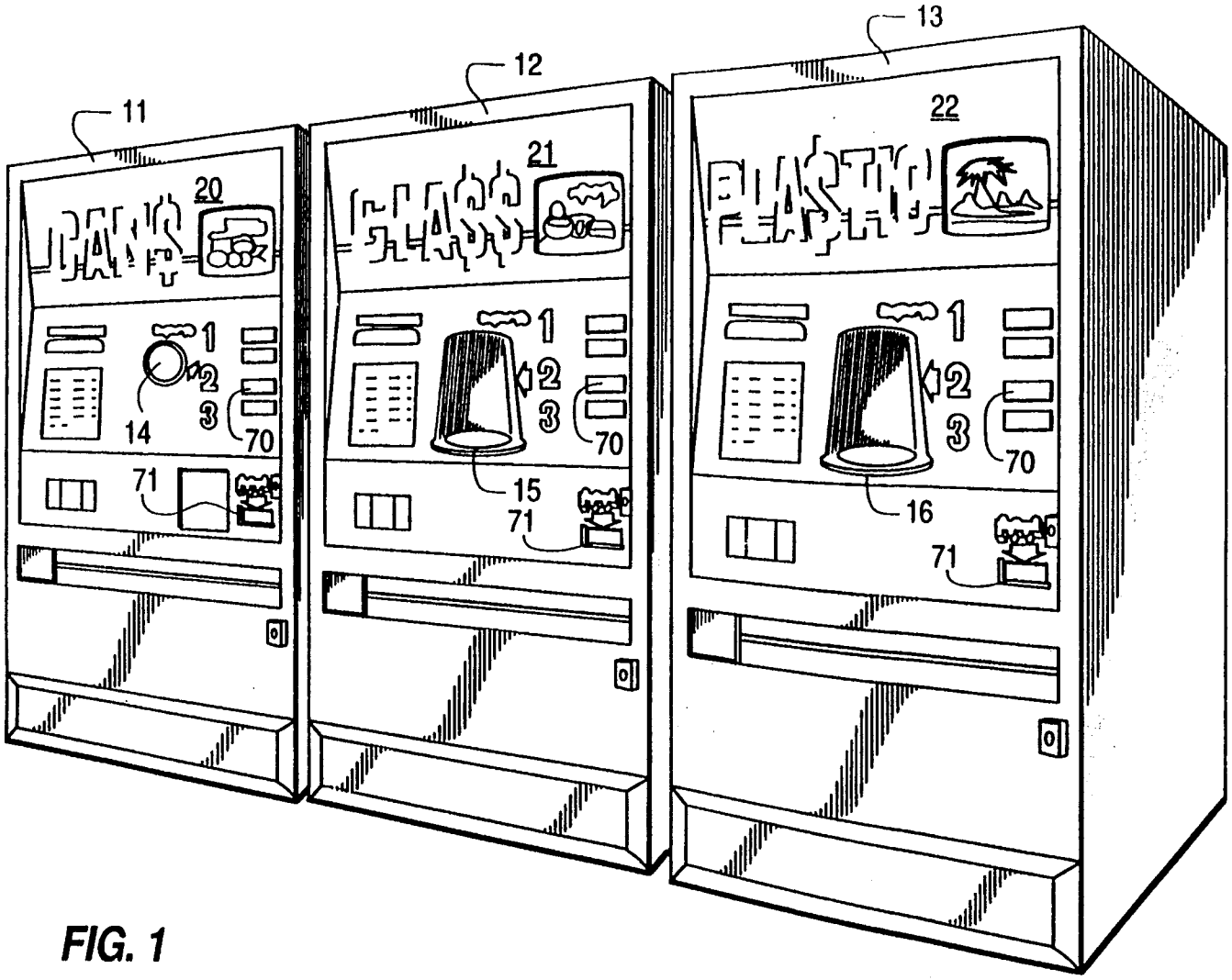
FIG. 1 is a perspective view of a typical collection station of the multiple used commodity collection and storage system of the present invention, showing separate reverse vending for cans, glass containers and plastic containers.
Figure 2:
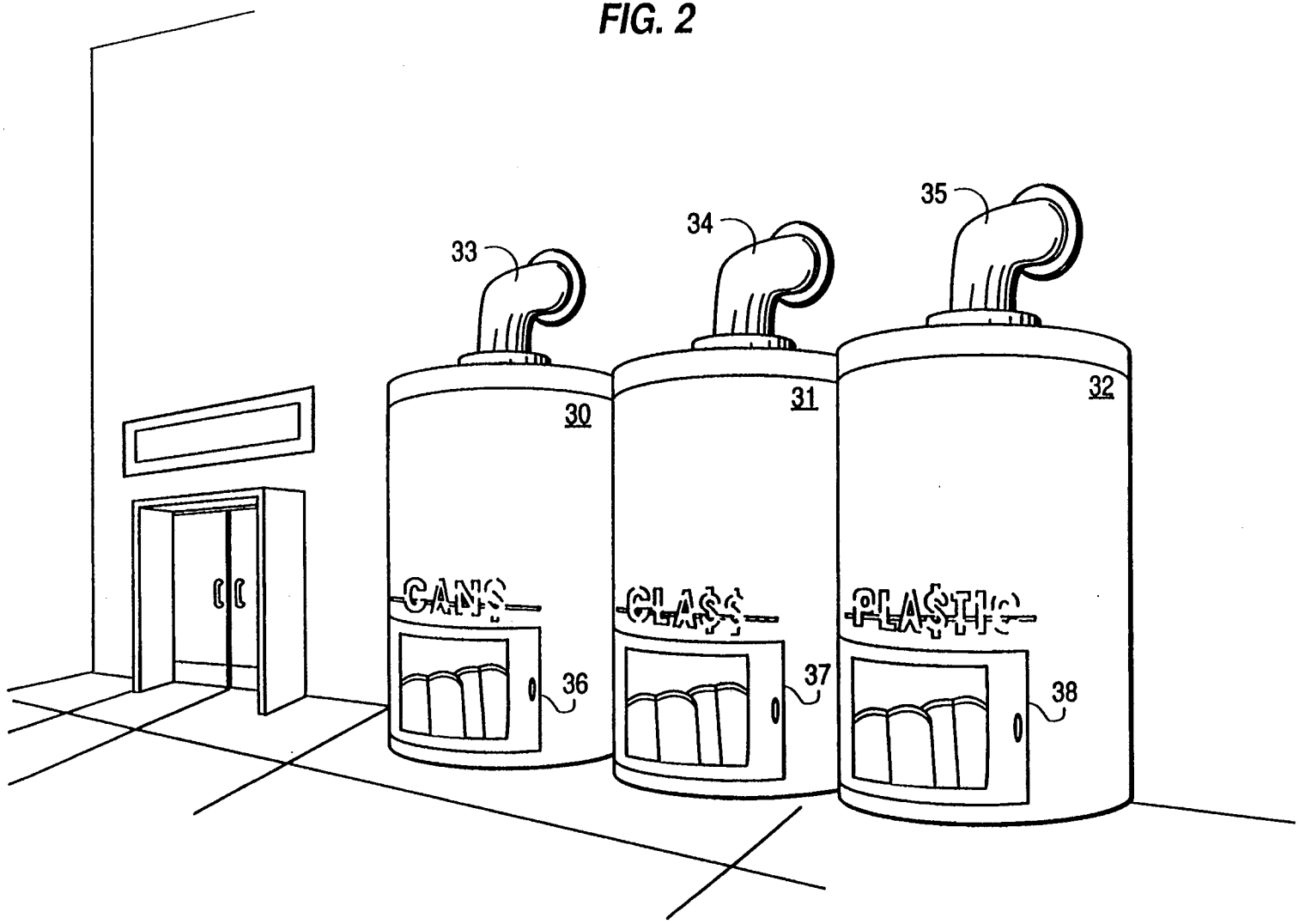
FIG. 2 is a perspective view of the bulk storage means of one station of the present invention showing the separate storage bin corresponding to each of the reverse vending machines in FIG. 1.

As shown in FIGS. 1 and 2, each station generally includes a plurality of reverse vending machines 11, 12 and 13. Each machine includes a consumer selectable insert port 14, 15 and 16. Each of these ports receives a different predetermined type or types of commodity. In the illustrated embodiment, port 14 is arranged for receiving aluminum cans, port 15 receives glass containers, and port 16 is configured for receiving plastic or polymer resin (PET) containers. The polymer resin may include, for example, high density polyethylene, polypropylene, polyvinyl chloride, or polyethylene terephthalate (PET).

Figure 10A:
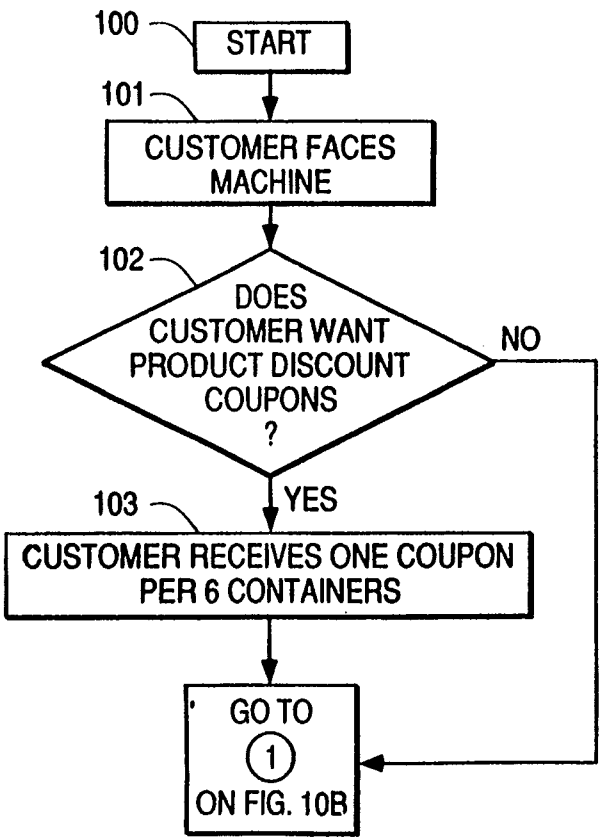
FIGS. 10A and 10B are operational flow charts of the can collection machine used with the system of the invention.
Figure 10B:
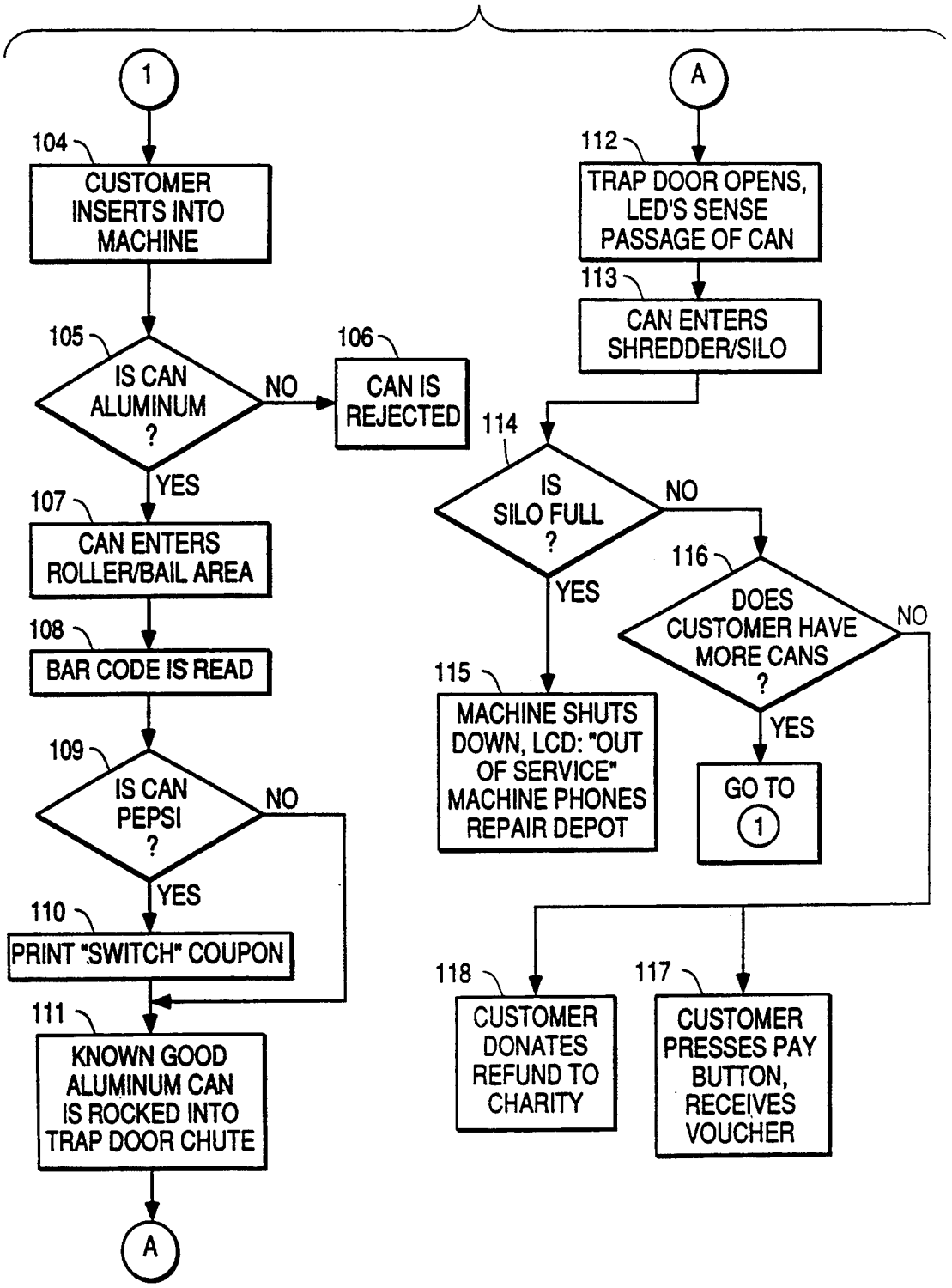

Each of the machines, 11, 12 and 13, includes a front panel 20, 21 and 22, with instructions and activation switches for use of the machine. The operation of such machines is described in prior patents of applicant's assignee, including U.S. Pat. Nos. 4,784,251; 4,492,295; 4,573,641; 4,440,284; 4,345,679; 4,324,325; 4,469,212; 4,919,534 and 4,579,216. FIGS. 10A and B, 11A and B, and 12A and B illustrate in flow chart form, the operation of each of the can, glass and plastic collection machines, respectively, typically used with the system of the invention. These charts are described more fully below.

As shown in FIG. 1, the insert port of each machine is configured to receive the particular predetermined commodity or commodities associated with that machine.

Within each machine 11, 12 and 13, and associated with each of the insert ports 14, 15, and 16, is pre-selection means for automatically verifying that an inserted commodity is of the predetermined type. Various alternatives for the pre-selection means are disclosed in the patents of applicant's assignee, incorporated by reference above. For example, an acoustic sensor, as disclosed in U.S. Pat. No. 4,784,251, the description of which is incorporated herein by reference, may be provided to sense a container, and a laser scanning mechanism may be provided to scan indicia such as a bar code on a label of the container. A light source assembly, as disclosed in U.S. Pat. No. 4,919,534, the description of which is incorporated herein by reference, may be utilized to pass a light beam through the container to analyze the character of light transmitted through the container utilizing the intensity measured by first and second light analyzers. U.S. Pat. No. 5,068,035 describes an acoustic holographic array measurement device, which may be used for identifying containers, the description of which is also incorporated herein by reference.

After the inserted commodity is verified as being of the predetermined type to be accepted by that particular machine, the commodity is accepted by the machine and transferred to a densifying means within the machine. For example, the shredding means disclosed in U.S. patent application Ser. No. 07/645,926 filed Jan. 25, 1991, and owned by applicant's assignee, the description of which is incorporated herein by reference, may be utilized. Other densifying mechanisms may be utilized, such as crushers and comminuting devices similar to those disclosed in U.S. Pat. Nos. 4,573,641 and 4,784,251, the descriptions of which are incorporated by reference herein.

As shown in FIG. 2, the bulk storage means includes a segregated storage area for separately storing each predetermined type of densified commodity. In the embodiment illustrated in FIG. 2, three storage bins 30, 31 and 32, are connected to the machines 11, 12 and 13, respectively, by enclosed conduits 33, 34 and 35. As illustrated, the bins 30, 31 and 32 correspond to the commodities, cans, glass and plastic. Each of the storage bins 30, 31 and 32 includes an access opening 36, 37 and 38 for removing densified commodities from the storage bins.

Figure 5:
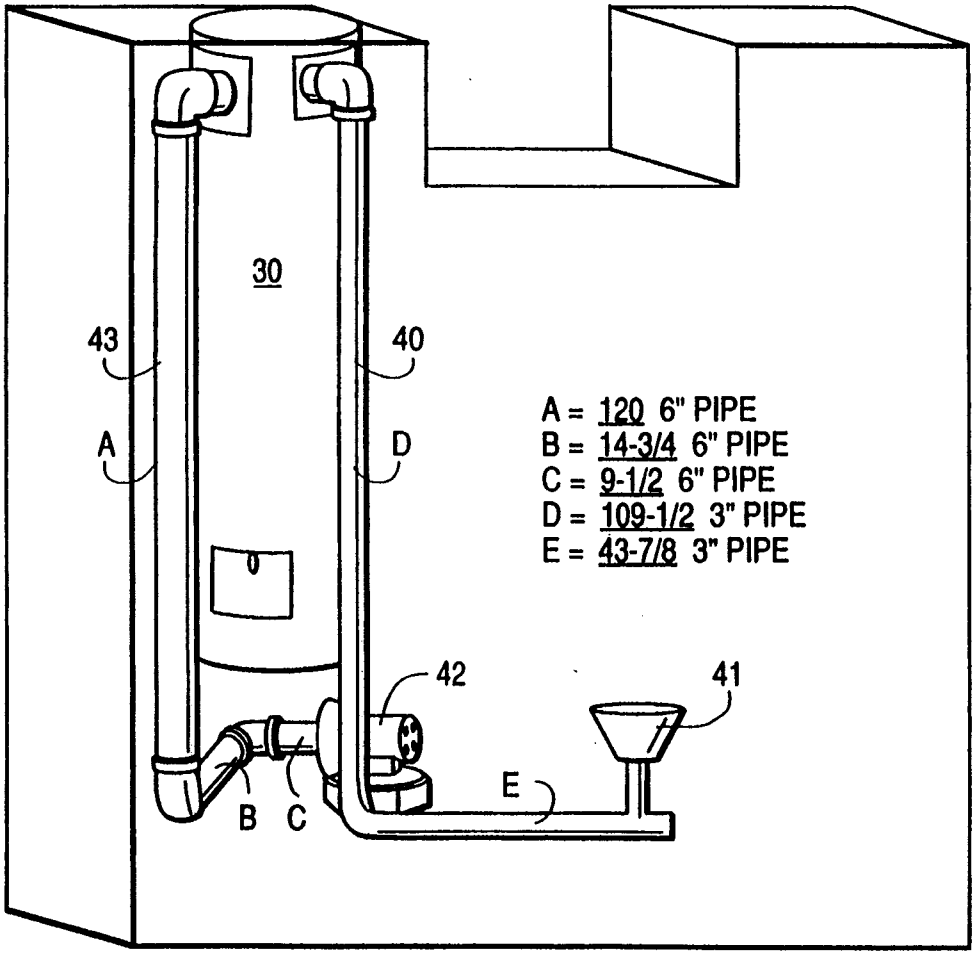
FIG. 5 is a perspective view of an embodiment of the bulk storage means and transfer means of the present invention particularly for use with cans.

As shown in FIGS. 5, 6, 7 and 8, the transfer means of the present invention may include pneumatic means for conveying the densified commodities from the densifying means to the bulk storage means. In the illustrated embodiment of FIG. 5, a transfer means and bulk storage bin for receiving densified cans is shown. In FIG. 5, the bulk storage bin 30 is connected to an intake pipe 40 which leads to a hopper 41 disposed for receiving the densified cans from the densifying means. A blower 42 draws air and densified or shredded cans through the hopper 41 and the inlet pipe 40 into the bin 30. An outlet tube 43 leads to the blower 42 for creating the suction effect. Based on the weight of the densified commodity, a one-horsepower blower may be used. The inlet pipe 40 is approximately three inches in diameter, and the outlet pipe 43 is four to six inches.

Figure 6:
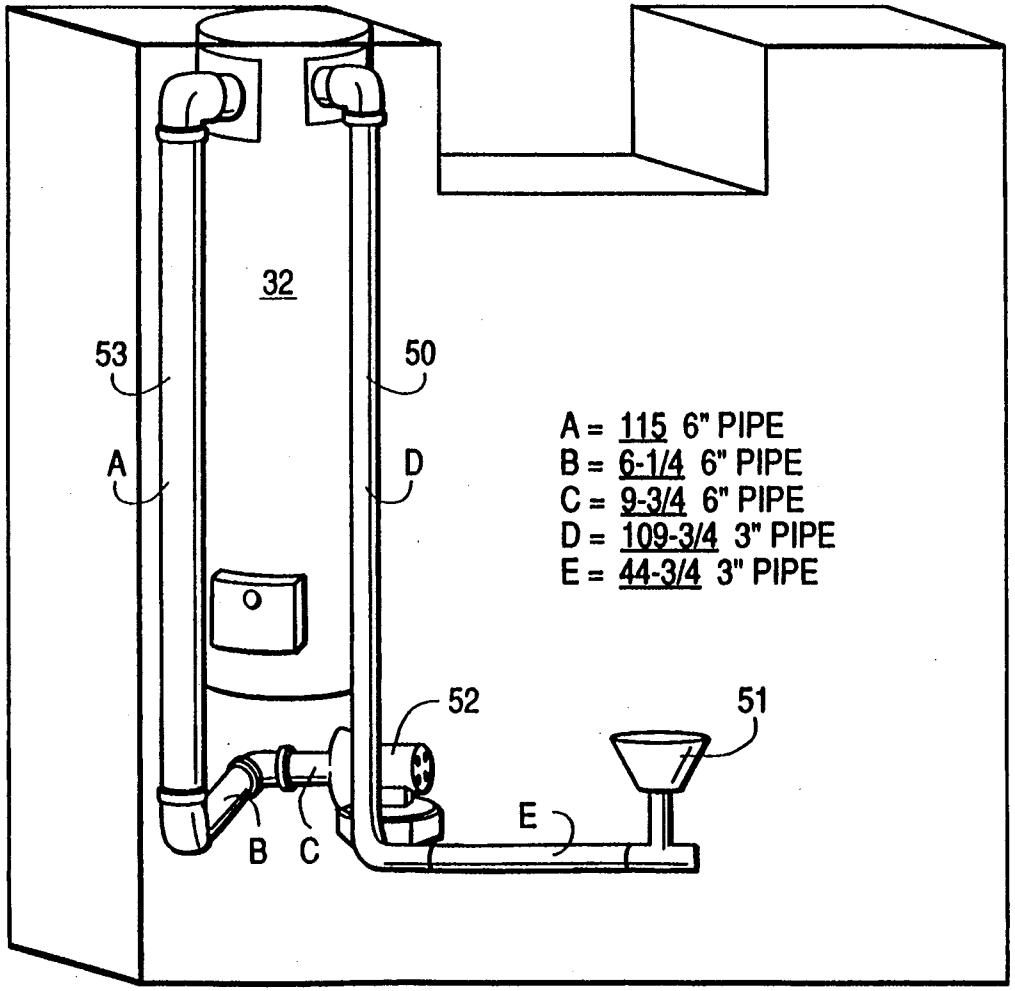
FIG. 6 is a perspective view of the bulk storage means for use with polymer resins or plastic containers and the associated means.

FIG. 6 illustrates a similar arrangement to FIG. 5 for use in connection with plastic containers. In this arrangement, the storage bin 32 is also connected to a three inch diameter inlet pipe 50 leading to a hopper 51 for receiving the densified or shredded plastic. The hopper 51 is disposed for receiving the densified plastic from the densifying means for the plastic machine 13. A blower 52 draws air and densified plastic through the hopper 51 and the inlet pipe 50 into the bin 32. The air continues through the outlet pipe 53 back to the blower 52. In this embodiment, a one horsepower blower may also be used in conjunction with a four to six inch outlet pipe and three inch inlet pipe.

Figure 7:
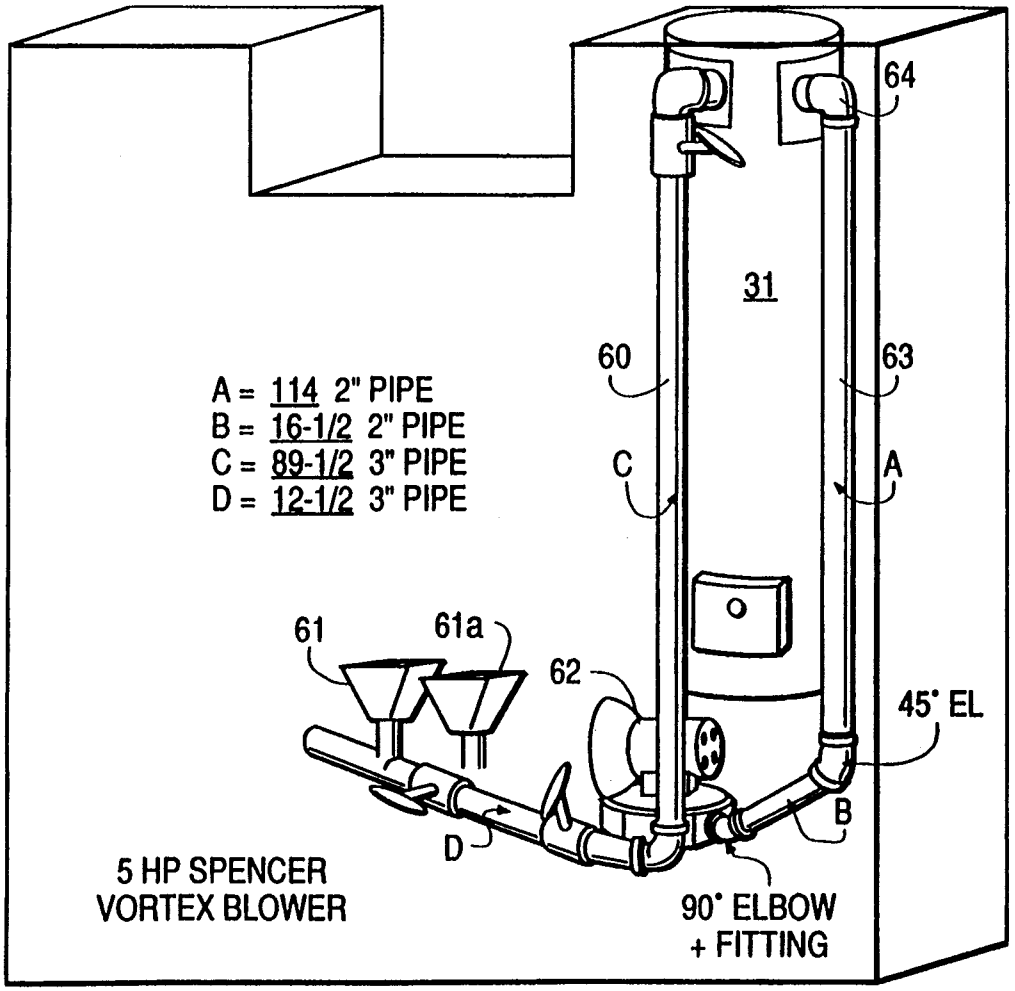
FIG. 7 is a perspective view of the bulk storage bin and associated pneumatic transfer means for use with the glass recycling machine for removing and storing clear glass.
Figure 8:
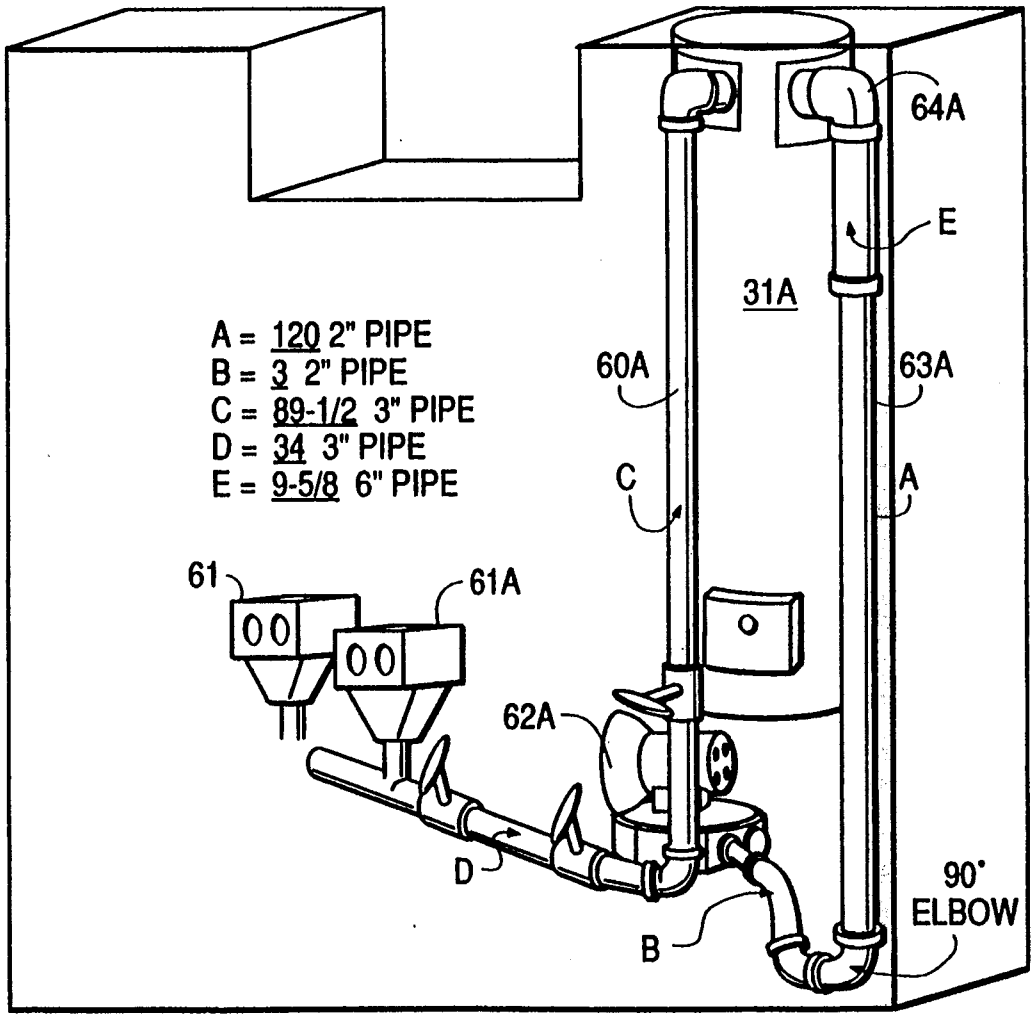
FIG. 8 is a perspective view of a storage bin and associated transfer means for transferring and storing colored glass from the glass recycling machine.

FIGS. 7 and 8 are similar illustrations of transfer mechanisms for use in connection with the glass machine. FIGS. 7 and 8 illustrate the use of two storage bins, one for receiving clear glass, and one for receiving colored glass. In FIG. 7, the storage bin 31 is connected to an inlet pipe 60 with a hopper 61 on the end thereof. The hopper 61 is positioned for receiving clear glass from the densifying means of the machine 12. A blower 62 draws air and glass particles through the hopper 61 and the inlet pipe 60 into the storage bin 31. The air then exits the storage bin through the outlet pipe 63 to the blower 62. A second hopper 61A is illustrated which receives the colored glass, as shown in FIG. 8. In the case of the glass particles, the inlet pipe is a three inch pipe, and the outlet pipe is approximately two inches in diameter. However, a six inch elbow 64 is also utilized at the air exit from the bin 31.

As shown in FIG. 8, the colored glass is carried to a second storage bin 31A by a separate blower 62A through the hopper 61A and the inlet pipe 60A. The air exits the storage bin 31A through an outlet pipe 63A. In this case, a three inch inlet pipe and a two inch outlet pipe are used. Because of the heavier nature of the glass particles, a five horsepower Spencer Vortex blower is used with the arrangements shown in FIGS. 7 and 8.

If desired, a single, more powerful blower (not shown) may be used, with microprocessor controlled valves (not shown) being arranged so that each different densified commodity may be transferred to the bulk storage bins by the suction of the single blower. This arrangement saves space, expense, and unnecessary power consumption.

Each of the reverse vending machines 11, 12 and 13 includes a means for issuing at least one token in response to the receipt of a predetermined commodity. For example, a push button on the front panel of each machine may be used to activate a coin dispenser, token dispenser, or coupon printer installed within the machine. Examples of such dispensers are described and illustrated in the patents of applicant's assignee, incorporated by reference herein. As shown in FIG. 1, a cash button 70 may be used to activate the dispenser and the token may be issued through the slot 71. In order to reduce the need for maintaining a supply of coins or currency in the machine, it is preferred that a coupon printing means be utilized for printing and issuing redeemable coupons or vouchers in response to the commodities received and verified by the pre-selection means. These coupons can be later exchanged for merchandise or cash, thereby eliminating the need for storing currency or coins in the machine. This in turn leads to less break-ins of the machines as it becomes known that nothing of value can be removed from the machine. Such coupon printing mechanisms are known in the art and may be readily incorporated in the machine by those skilled in the art.

Each of the machines 11, 12 and 13, includes a microprocessor for storing data corresponding to the commodities verified by the pre-selection means, as described in the patents of applicant's assignee, incorporated by reference herein. For example, as described in U.S. Pat. No. 4,579,216, the description of which is incorporated herein by reference, the machine may include a mechanism for reading the universal product code from a particular container, or a means for acoustically determining the shape of the container to identify its source, as disclosed in U.S. Pat. No. 5,068,035 owned by applicant's assignee, the description of which is also incorporated by reference herein. As described in the '216 patent, the microprocessor may communicate with a central processing unit in a central coordination facility to communicate data on the quantity and type of commodities collected. Based on this data, routing of vehicles to the particular stations in the system may be efficiently planned. In addition, each station may generate data indicating failure parameters in the machines and transmit that data to the central processing unit so that repair personnel may be efficiently dispatched. The remote access may be done automatically by telephone so that no manual operation is required to obtain the necessary data from the collection stations.

If desired, each of the machines 11, 12 and 13 may include prestorage means including a separate space for each predetermined type of commodity. For example, a limited size storage space may be provided in each machine, and the densified commodity may be periodically transferred to the bulk storage means if desired.

The prestorage means may include a chamber in the lower portion of the reverse vending machines 11, 12 and 13 for receiving the densified commodities directly from the densifying means. In this arrangement, the hoppers 41, 51, 61 and 61A are arranged in a lower portion of the prestorage area. Transfer to the bulk storage bins 30, 31, 31A and 32 can be effected automatically at predetermined intervals, or when the prestorage area is filled to a predetermined capacity.

The system of the present invention preferably includes a plurality of mobile commodity collection and storage assemblies, such as collection vehicles, each vehicle including a transport compartment and means for automatically loading the densified commodity of at least one of the predetermined types from the bulk storage means into the transport compartment. As embodied herein, and as broadly illustrated in FIG. 9, each commodity collection vehicle is a truck or trailer 90 having a transport compartment 91 thereon. A vacuum suction apparatus 92 may be provided on the truck or trailer 90 for automatically transferring the densified commodity from the storage bin 30, 31, 32 to the vehicle 90. A plurality of separate segregated compartments 93 may be provided in the vehicle 90 for receiving each different densified commodity.

Figure 9:
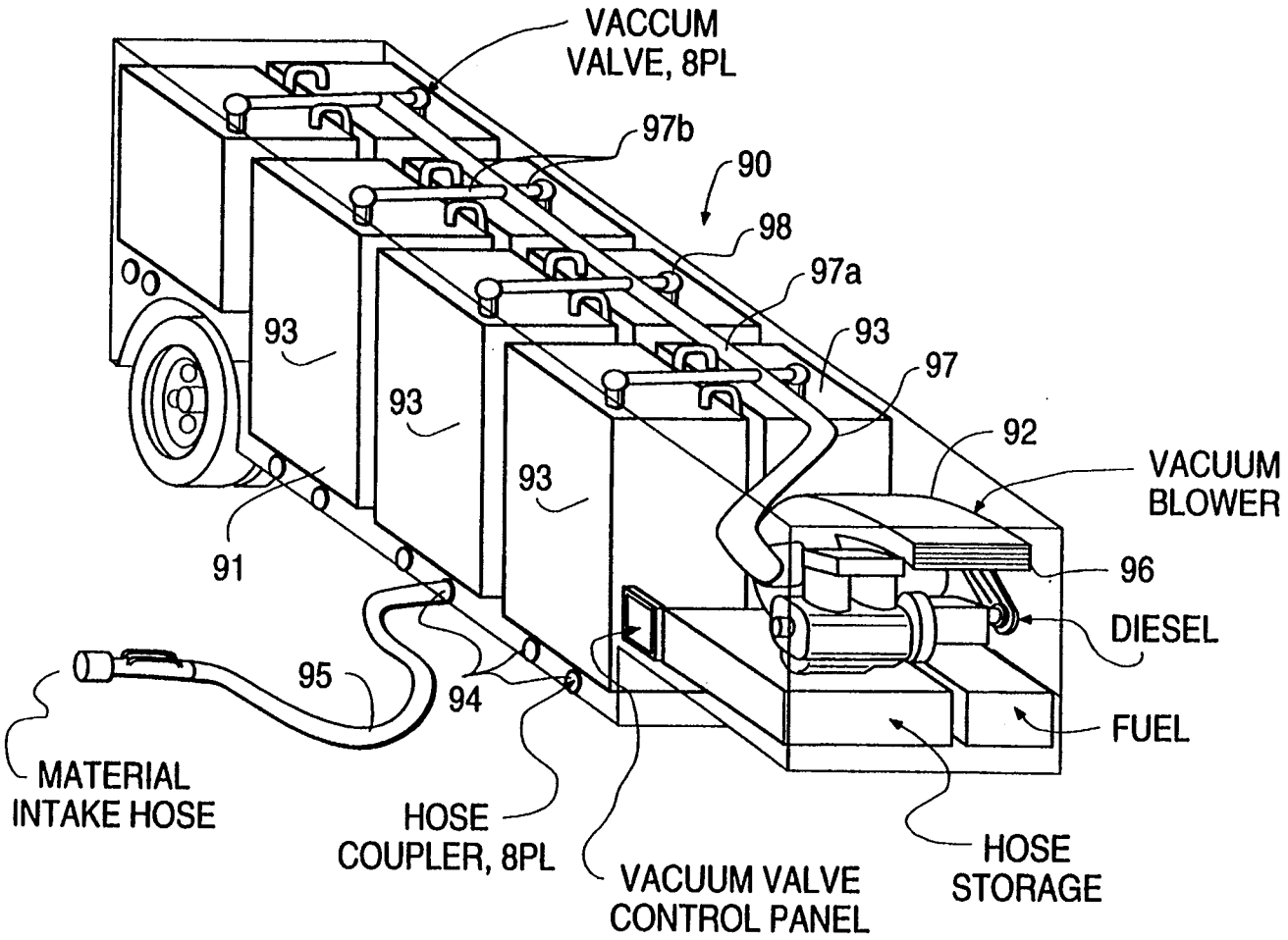
FIG. 9 is a partial perspective view of a trailer portion of one embodiment of a mobile commodity collection and storage assembly according to the present invention.
Figure 14:
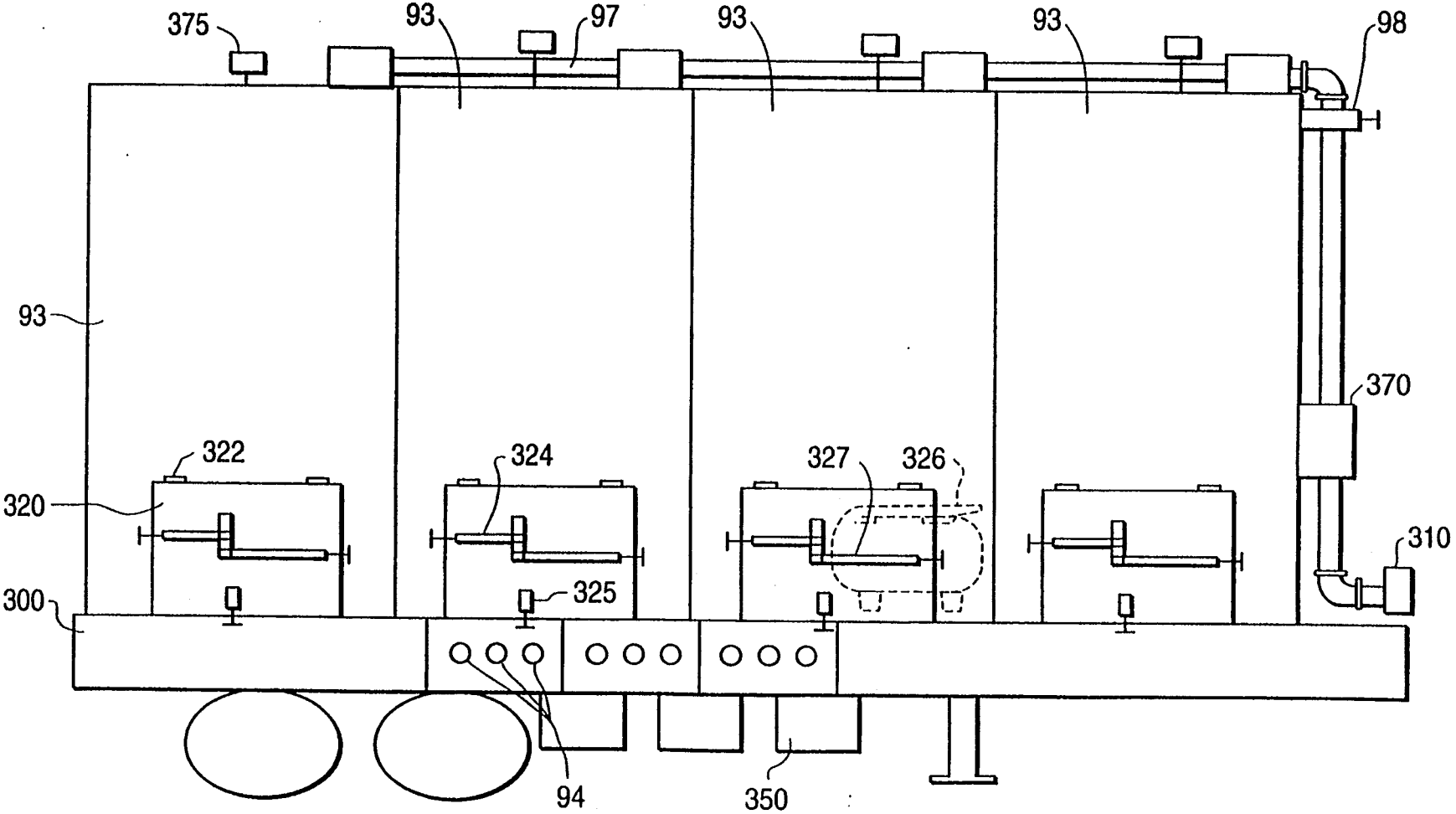
FIG. 14 is a side view of a trailer portion of another embodiment of a mobile commodity collection and storage assembly according to the present invention.

Transfer means are provided for transferring a commodity into each compartment as embodied in FIG. 9. Preferably, a plurality hose couplings 94 are provided on a side of the trailer, which may be used for rapid attachment and detachment of a hose 95. The couplings connect to respective piping (not shown) which penetrates each segregated compartment 93. Preferably, each hose 95 is a flexible plastic hose, strengthened with interlaced wires or other strengthening means, suitable for use in handling densified commodities such as crushed glass or shredded aluminum. Typically, a 6" diameter hose 95 is used to draw suction on and collect the respective densified commodity. However, it is also within the scope of the present invention to handle undensified commodities, such as whole bottles or cans. In this case, a larger (8" or 10" diameter) hose 95 may be required. The various hoses 95 can be stored anywhere in the trailer. For example, as shown in FIG. 14, storage boxes 350 are mounted beneath the trailer for storing hoses 95.

In accordance with the invention, vacuum means are provided for drawing a vacuum in the compartments. The preferred embodiment shown in FIG. 9 also depicts a vacuum blower 96, mounted to the trailer 90, for drawing a suction on each compartment 93. Preferably, the vacuum blower should be a positive displacement vacuum pump capable of producing a vacuum of 18" Hg at atmospheric pressure at sea level, include a soundproof enclosure and dustbox, and be of suitable size to mount to a truck chassis. A suitable vacuum blower is commercially available under the trade name Hi-Vac Model 275, manufactured by the Hi-Vac Corporation of Marietta, Ohio.

Preferably, vacuum blower 96 is connected to the top of each separate compartment via piping 97. As depicted in FIG. 9, piping 97 comprises a 6" diameter central manifold **97*a*, and branch lines 97*b*. Each branch line 97*b* is connected via a coupling to piping which penetrates the top of each respective storage compartment 93. Each branch line 97*b*** includes a filter element (not shown), such as a mesh screen, to filter any densified commodity particles exiting the storage compartment in the air stream.

In accordance with the invention, vacuum control means are provided for controlling application of the vacuum such that it can be drawn in a selected compartment, and not drawn in another selected compartment. As embodied in FIG. 9, a vacuum valve 98 is provided in each branch line **97*b*, which is preferably a 6" diameter air butterfly valve. It is preferred that each butterfly valve also can be manually operated. It is further preferred that each vacuum valve 98 have the capability to be opened independently of the other vacuum valves. When one vacuum valve 98 is opened, its respective compartment 93 can be subjected to vacuum upon energization of vacuum blower 96. However, in the preferred embodiment, no other compartment 93 will be subjected to vacuum, unless its respective vacuum valve 98** is also opened. Hence, selected compartments may be subject to vacuum, in order to receive densified commodities from those compartments, while other compartments remain at atmospheric pressure. This enables certain compartments to be serviced or emptied, while other compartments are being filled with a densified commodity.

Another embodiment of the collection assembly of the present invention is broadly depicted in FIG. 14. A principal distinction in the embodiment of FIG. 14 from the embodiment of FIG. 9 is that while the storage compartments 93 and piping 97 are mounted on a trailer 300, the vacuum blower 96 is not mounted on the trailer. Rather, the vacuum blower 96 (not shown in FIG. 14) is mounted separately on a truck or other large vehicle. The piping 97 is provided with a disconnect fitting 310 allowing for disconnection of the vacuum piping from the vacuum blower 96 when the trailer 300 is to be removed from its vehicle.

In accordance with the invention, each compartment includes an access door. Referring to FIG. 14, a door 320 is provided on the outer side wall of each compartment 93. As embodied herein, each side door is pivotally connected at its upper edge to its compartment side wall via hinges 322, and opens outwardly, for ease of unloading the commodities stored in the compartment. The door 320 is pivoted open and shut by a pneumatic ram 326 attached to the inner side of each door, which is activated by a 30 gallon compressed air tank 327. The door is remotely operated from a control console on one side of trailer 300, described below.

Preferably, each access door includes locking means to prevent opening the access door at selected times. As broadly embodied in FIG. 14, a manual latch 324, and a remotely-operated air cylinder latch 325, are provided to lock the access door 320. Other locking devices can be provided as are known to those of ordinary skill in the art. The locking devices prevent inadvertent operation of the doors while commodities are being collected or the vehicle is on the road, and also prevents theft of the stored commodities.

Figure 15:
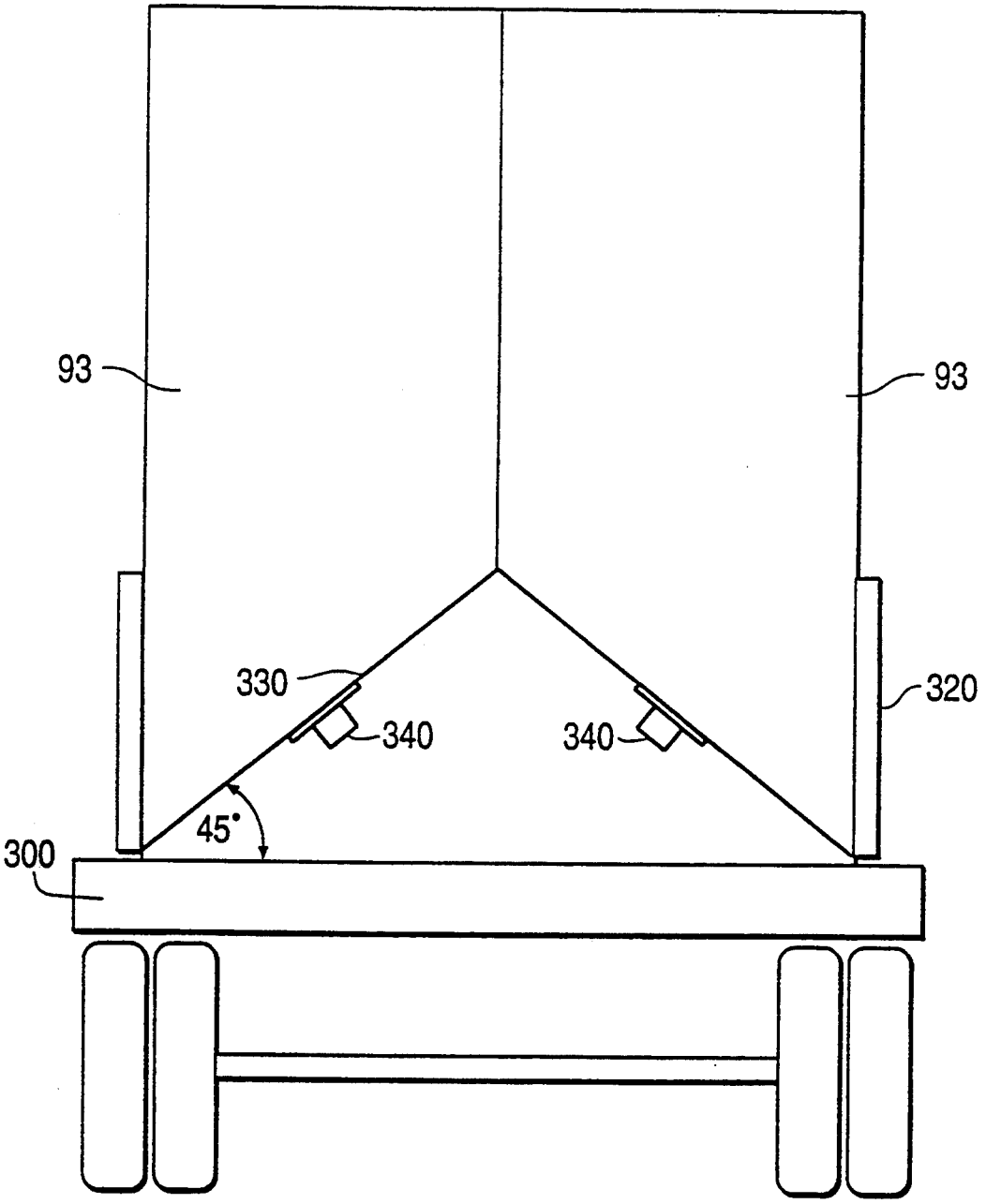
FIG. 15 is a top view of the trailer depicted in FIG. 14.

In accordance with the invention, each storage compartment includes a floor portion which is angled toward the access doors. As depicted in FIG. 15, the floor 330 of each compartment 93 is slanted at approximately a 45° angle with respect to the horizon, sloping down toward the access door 320. This angled floor 330 is provided in order to utilize the force of gravity to urge the stored commodity toward the door 320 to thereby assist in unloading the stored commodity from compartment 93 when the access door is opened at the recycling center.

Preferably, flow assist means are provided for encouraging flow of the commodity down the angled floor toward the access door. The flow assist means are also provided for ease of unloading the commodity. As depicted in FIG. 15, a plurality of electric motors 340, each having a 3" ball vibrator, are bolted to the underside of slanted floor portions 330 of each compartment 93. When energized, the vibrator vibrates the respective floor portion, assisting gravity in causing the stored commodity to flow towards the respective access door 320. The vibrator thus assists gravity in unloading the respective compartment. Other flow assist devices can also be employed. For example, forced air jets could be provided in each compartment 93 to provide a flow of air along the floor 330 when access door 320 is open. Alternatively, a rotary paddle wheel or other device could be provided on the floor 330 to stir the commodity and assist it in being unloaded out the access door 320.

Figure 16:
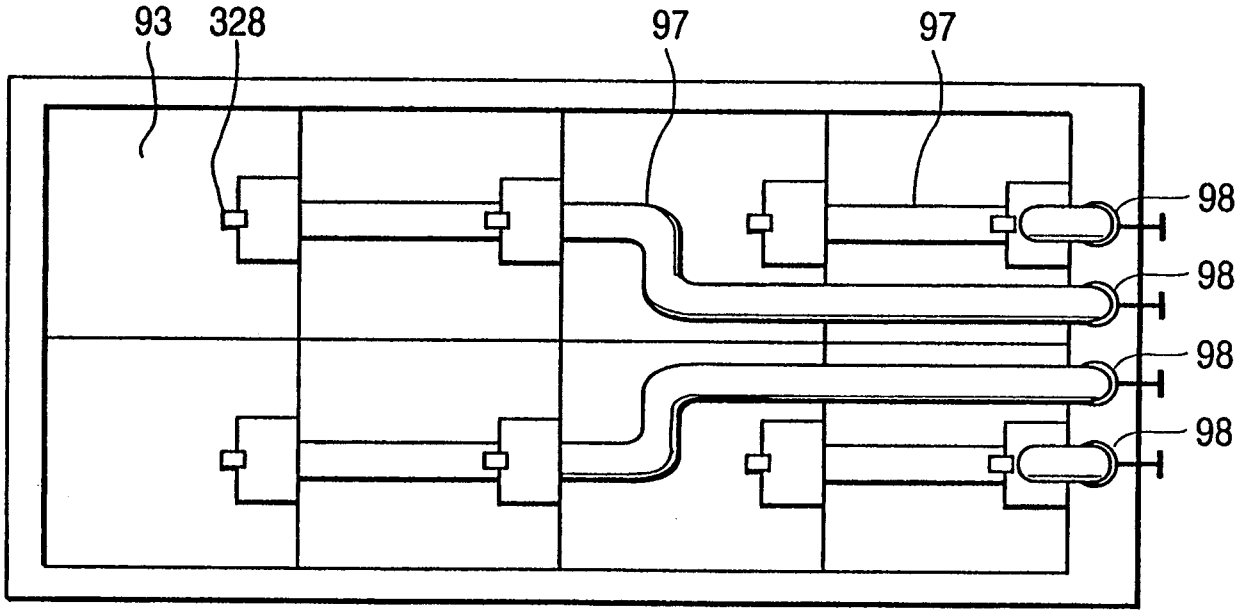
FIG. 16 is a rear view of the trailer depicted in FIG. 14.

FIG. 16 is a top view of the collection assembly, depicting an alternate arrangement of the vacuum piping and vacuum valves. In FIG. 16, separate manifolds 97 are provided, each connected to a pair of adjacent storage compartments 93. Vacuum valves 98, which are preferably 6" diameter air operated butterfly valves, are provided with each manifold 97. It will be readily understood that, in the embodiment depicted in FIG. 16, opening one vacuum valve 98 places two adjacent storage compartments 93 on service (under vacuum), rather than a single storage compartment, as was the case with the embodiment depicted in FIG. 9. When, in the embodiment of FIG. 6, two adjacent storage compartments are placed under vacuum, the remaining pairs of compartments may either be placed under vacuum or left at atmospheric pressure, as desired by the operator. Preferably, as depicted in FIG. 16, each compartment is provided with a vacuum relief valve 328, set at 16" Hg.

Figure 17:
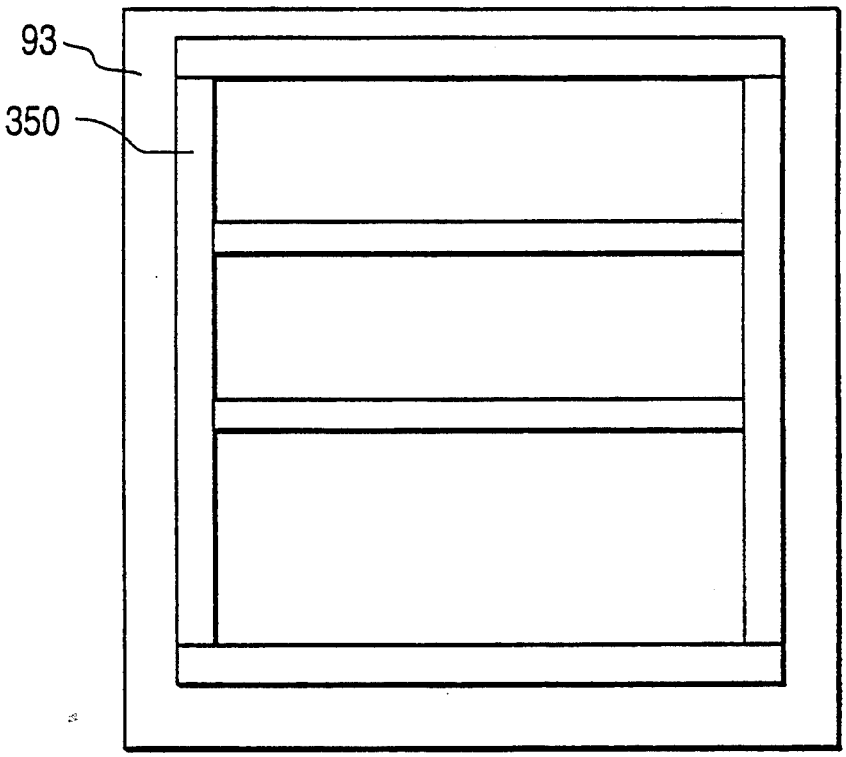
FIG. 17 is a partial view of an internal side wall of one of the compartments depicted in FIGS. 9 and 14.

Previous collection vehicle storage compartments have had insufficient wall strength to avoid collapsing when vacuum is applied to the compartment. Preferably, the walls of the storage compartments 93 are configured with a plurality of strength members 350, such as conventional 1"×3" studs, mounted adjacent the inner wall and access door, as broadly depicted in FIG. 17.

Preferably, a control panel 370 is provided mounted on one side of the trailer, for operator control of the vehicle functions. The control panel 370 includes switches for independently operating the vacuum valves 98, switches for operating the individual air cylinder latches 325, and switches for operating individual vibrator motors 330. The control panel 370 also includes a readout for the level of densified commodity stored in each compartment, which is sensed by respective level sensors 375 disposed in each compartment.

The preferred embodiment of the vehicle described above shall have an overall length of 360", a height of 160", a weight capacity of approximately 23,528 lbs. at 17 lbs. per cubic foot of material, a storage capacity of approximately 1384 cubic feet, and an empty trailer weight of 28,000 lbs.

Figure 3:
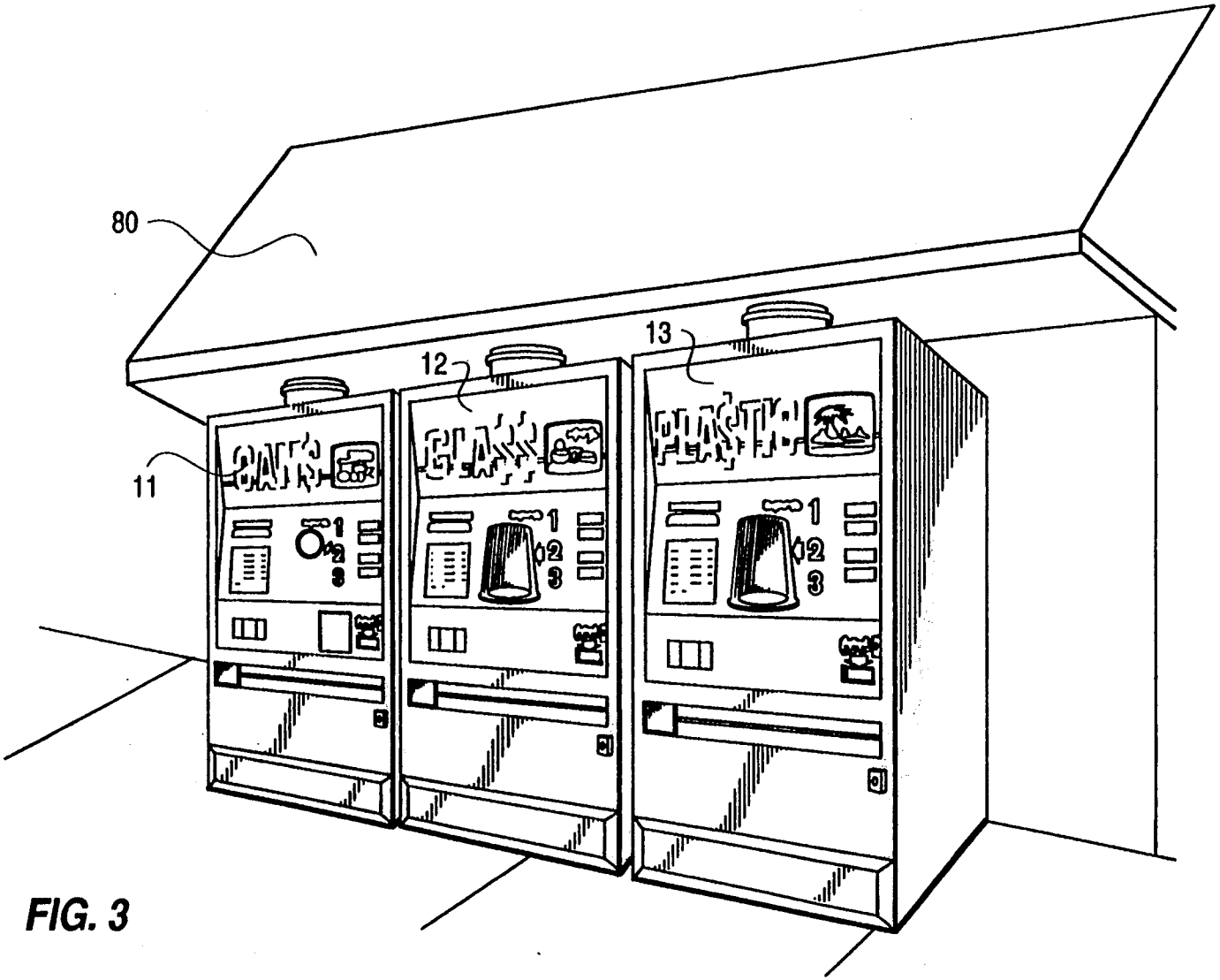
FIG. 3 is a perspective view, similar to FIG. 1, showing the reverse vending machines of one collection station configured for outdoor use.
Figure 4:
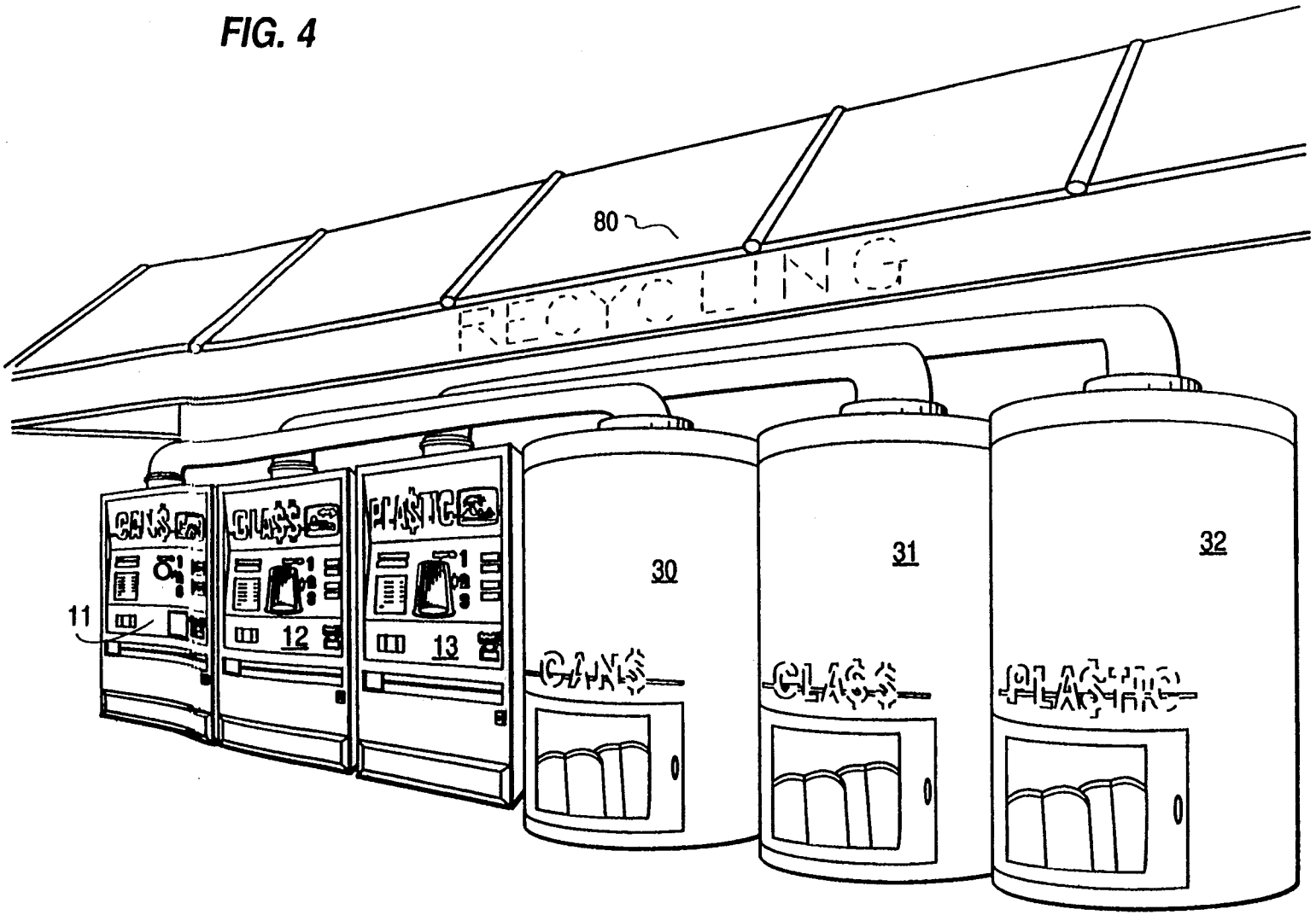
FIG. 4 is a perspective view of another embodiment of the present invention with the bulk storage bins aligned contiguous to the reverse vending machines.

Further configurations for the stations are shown in FIGS. 3 and 4. FIG. 3 depicts the machines 11, 12, and 13 in an outdoor storage environment, beneath a suitable awning or roof 80. In FIG. 4, the storage bins 30, 31 and 32 are arranged side-by-side with the reverse vending machines 11, 12 and 13. In FIG. 4, an awning or roof 80 is also provided.

In accordance with another aspect of the present invention, a method of collecting a plurality of commodities includes the step of densifying each of the plurality of commodities into a plurality of densified materials. As broadly embodied herein, the step of densifying may be performed by the shredding means disclosed above, which may be those described in U.S. Pat. application Ser. No. 07/645,926, or U.S. Pat. Nos. 4,573,641 and 4,784,251, owned by applicant's assignee, the descriptions of which are incorporated by reference herein.

In accordance with the invention, the method also includes collecting the plurality of densified materials into at least one of a plurality of segregated temporary storage bins. As broadly embodied in FIG. 2, the densified materials may be collected in one of storage bins 30, 31, and 32.

In accordance with the invention, the method also includes transferring at least one of the plurality of densified materials to at least one of a plurality of segregated storage compartments on a mobile multi-compartment storage vehicle. As broadly shown in FIGS. 9–14, the densified materials may be transferred to one of the compartments 93 within the vehicle 90. If the plurality of commodities to be densified comprises a plurality of commodities composed of different materials, the different densified materials may be transferred into respective segregated storage compartments 93 on the mobile storage vehicle 90 from respective storage bins 30, 31, 32.

In accordance with the invention, the step of transferring includes using a vacuum source on the mobile storage vehicle to draw vacuum on the at least one segregated storage compartment on the mobile storage vehicle and transferring the densified material into the at least one storage compartment under vacuum via a hose. As broadly embodied herein, and as shown in FIG. 9, vacuum suction apparatus 92 including vacuum blower 96 draws vacuum on the storage compartments 93 through piping 97. The densified material is thus transferred into the storage compartments 93 by vacuum through hose 95 connected to the storage bins 30, 31, 32. A plurality of vacuum valves 98 are provided in branch lines **97*b* which are communicated with piping 97 by central manifold 97*a*, the valves being capable placing at least one storage compartment 93** under vacuum while other storage compartments are not under vacuum.

In accordance with another aspect of the present invention, a method of collecting and transporting a plurality of densified recyclable commodities includes the step of temporarily storing the densified recyclable commodity in a plurality of respective segregated storage bins while maintaining a segregation of the densified recyclable commodities. As broadly shown in FIGS. 2 and 4, the densified recyclable commodities may be stored in storage bins 30, 31, 32 while maintaining the segregation of the recyclable commodities within each bin.

In accordance with the invention, the method also includes transferring the densified recyclable commodities from the segregated storage bins to respective segregated storage compartments on a mobile multi-compartment storage vehicle while maintaining the segregation of the densified recyclable commodities. As discussed above, this transfer can be performed using the vacuum suction apparatus 92, the piping 97, the hose 95 and the valves 98.

In accordance with the invention, the method also includes transporting the segregated densified recyclable commodities to another storage location. As broadly embodied herein, the vehicle 90 can be transported to another location thereby transporting the commodities.

In accordance with another aspect of the invention, a method of collecting and transporting a plurality of segregated densified materials stored in respective segregated temporary storage bins, includes the step of drawing vacuum in a first segregated storage compartment on a multi-compartment storage vehicle. As broadly embodied herein, materials stored in bins 30, 31, 32 are collected and into a vehicle 90 by drawing vacuum using vacuum suction means 92 in communication with a first storage compartment 93 on the vehicle.

In accordance with the invention, the method also includes placing a first end of a transfer hose in communication with a first of the plurality of segregated densified materials and connecting a second end of the transfer hose to a first transfer valve communicating with the first segregated storage compartment. As shown in FIGS. 9 and 14, the first end of the transfer hose 95 is placed in communication with densified materials, for instance, stored in the storage bin 30, 31, or 32. The second end of the transfer hose 95 is connected to a hose coupling 94 in communication with the first compartment 93, which is further in communication with a transfer valve 98 for communicating the vacuum from the vacuum suction means 92.

In accordance with the invention, the method further includes opening the first transfer valve to transfer the first segregated densified material into the first segregated storage compartment. As embodied herein, the transfer valve 98 is opened to transfer the densified material into the first storage compartment 93.

In accordance with the invention, the above steps are repeated for a second segregated storage compartment to transfer at least the second segregated densified material into the second storage compartment. The method further includes transporting the first and second segregated materials to another storage location, the vehicle 90 being transportable to thereby transport he first and second segregated materials.

As shown in FIGS. 10A, 10B through 12A, 12B, the reverse vending machines 11, 12, and 13, generally operate according to the flow charts illustrated. In the case of the can collection machine, the customer initiates the operation by facing the machine at block 101, and selecting whether product coupons are desired (102). If coupons are chosen, one coupon will be issued by the machine for each six cans received by the machine (103). The consumer then inserts the can into the machine (104), and the pre-selection means determines whether the can is aluminum (105). If the can is not aluminum, it is rejected (106), and the consumer must insert another can to continue. When an aluminum can is present, the machine reads the bar code on the can (107, 108). Thereafter, additional messages can be optionally printed for particular manufacturers, if desired (109,110). When the can has been determined as acceptable, it is fed to the can shredder for densifying and transfer to the storage bin 30 (111, 112, 113). If the storage bin 30 is full, the machine shuts down and an error message appears (114, 115). If the shredded can is properly transferred to the bulk storage bin 30, and the bin is not full, the customer may insert the next can into the insert port 14 (116). In this case, the operation starts again at block 104. When the customer has finished inserting all cans, a decision can be made to donate the proceeds (value or deposit refunds) to charity (118), or to receive a voucher for subsequent payment in cash (117).

Figure 11A:
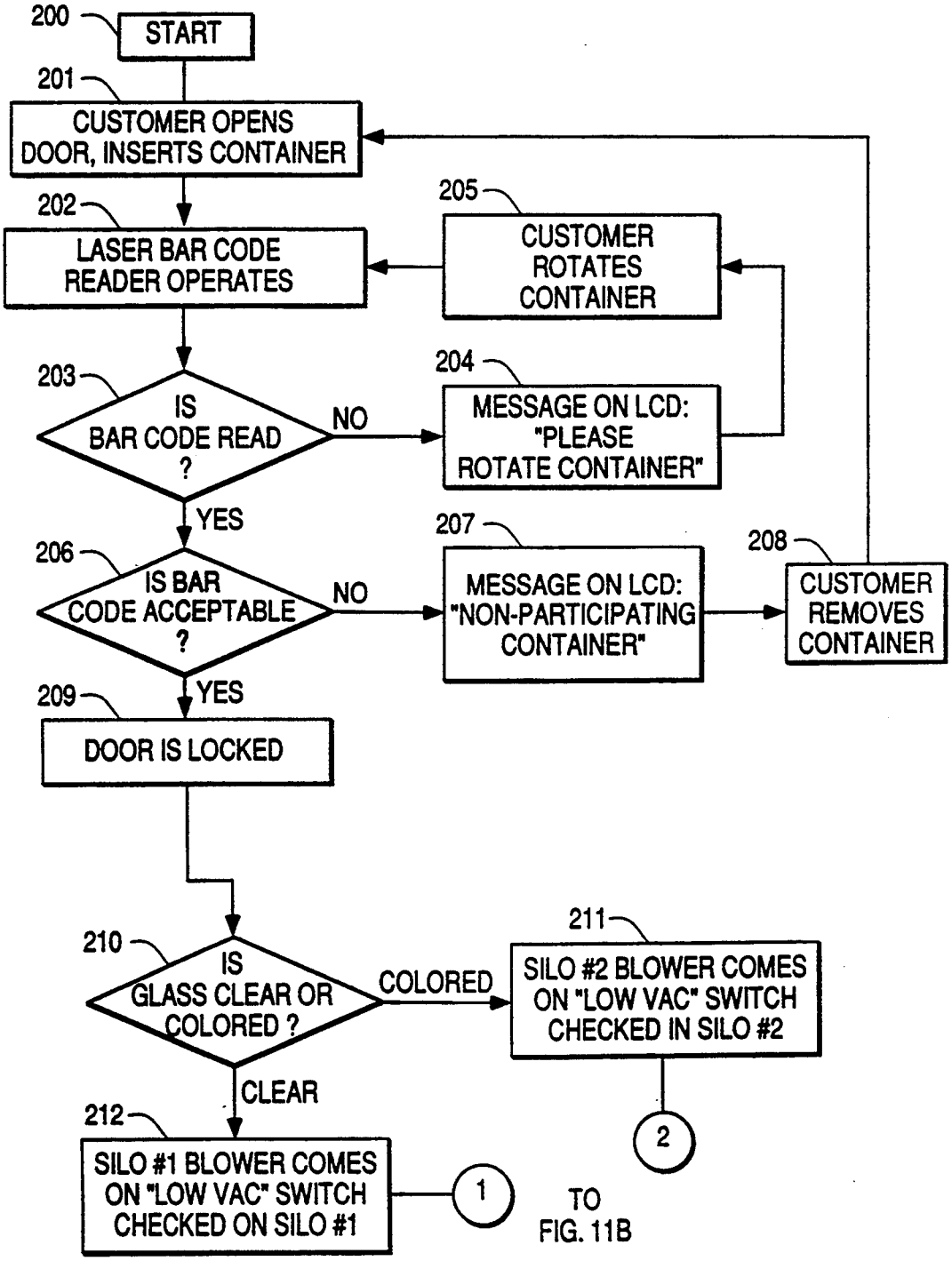
FIGS. 11A and 11B are operational flow charts of the glass collection machine used in the system of the present invention.
Figure 11B:
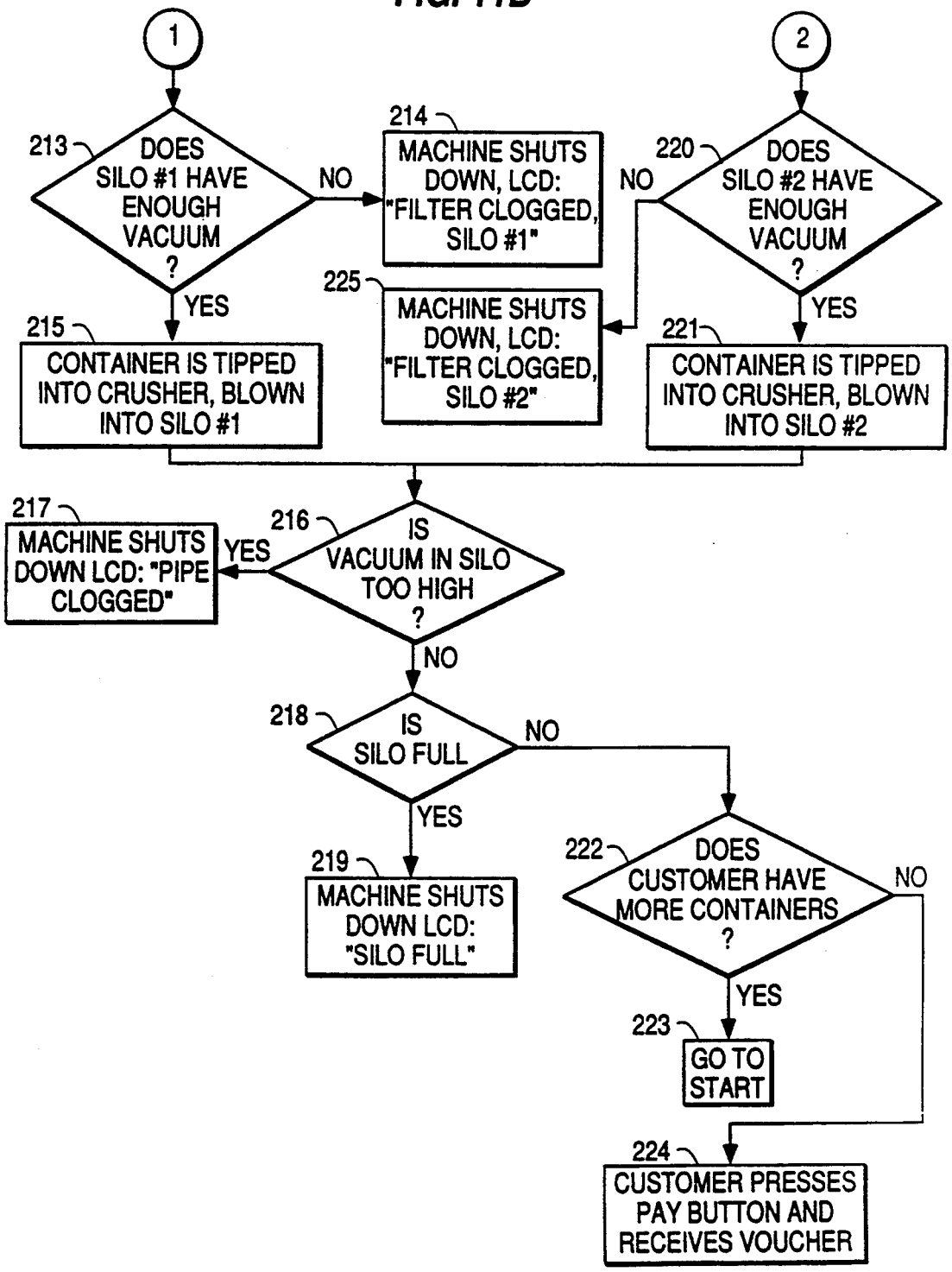

In the case of the glass collection machine, the operation is substantially similar, as shown in FIGS. 11A and 11B. However, the glass machine has a protective door (201), and the customer may be required to rotate the container to allow for proper reading of the bar code label (202, 203, 204, 205). Another optional routine is shown in FIG. 11A regarding the acceptability of the container as a "participating" vendor (207, 208). Once the door is locked (209), the machine determines whether the glass is colored or clear (210). This determines which blower or valve will activate to transfer the crushed glass to the proper storage bin (211, 212). Also, a determination is made by appropriate sensors whether the receiving bin has enough vacuum (213, 220). An error message appears if the vacuum is too low (214, 225). If the storage bin has sufficient vacuum, the bottle is crushed (215, 221) and blown into the appropriate storage bin 31, 31A. However, there is an additional check on the vacuum in the storage bin (216) to determine if it is too high. If so, the machine shuts down (217). If the vacuum is acceptable, and the storage bin is not full (218), the customer may insert another container (222, 223), or request a payment voucher (224). If the storage bin is full (219), the machine stops and a "full" message appears.

Figure 12B:
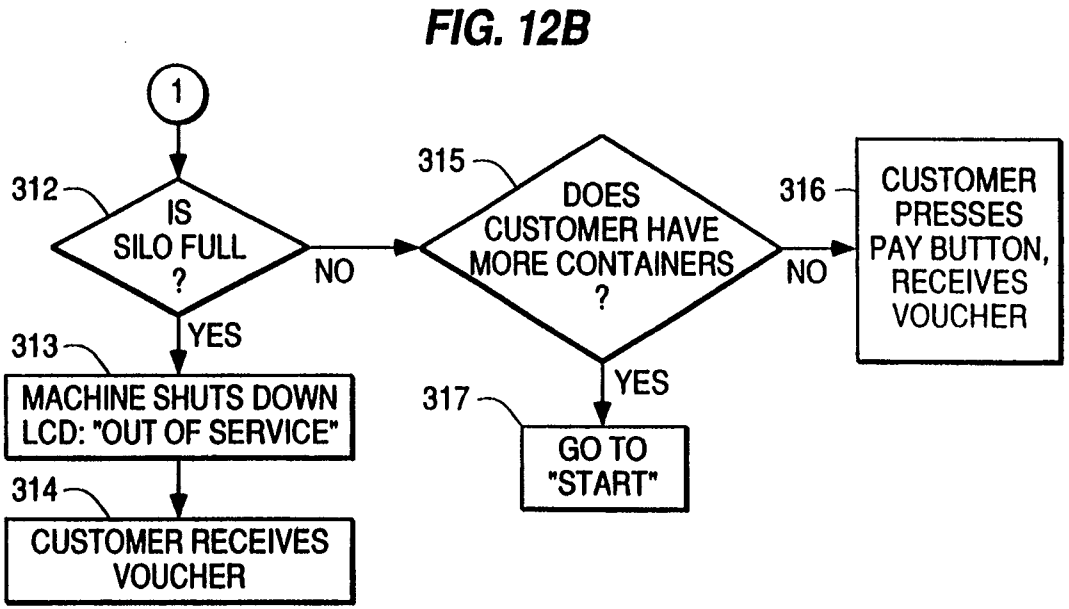
FIGS. 12A and 12B are operational flow charts of the plastic collection machine used in the system of the invention.
Figure 12A:
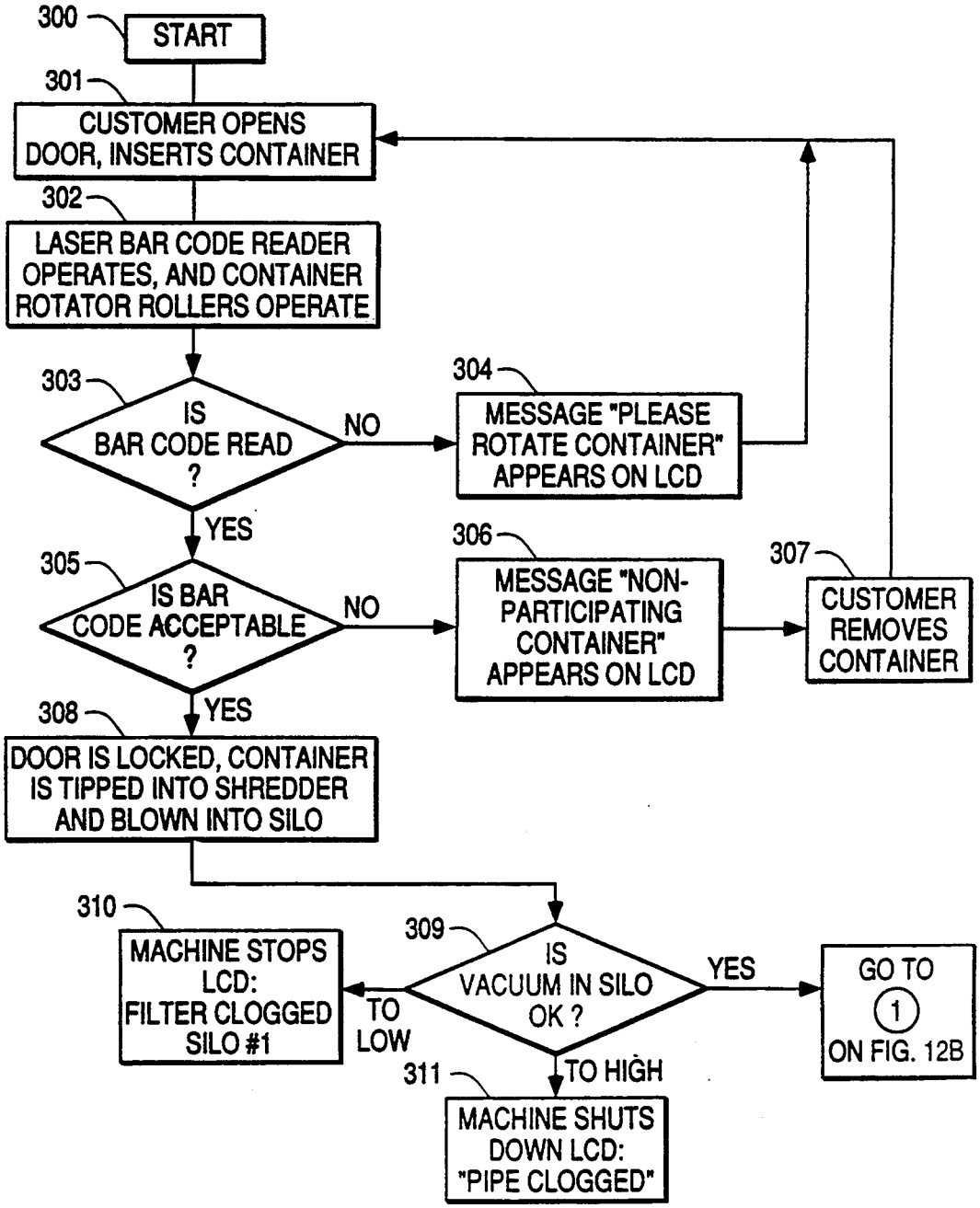
Figure 13:
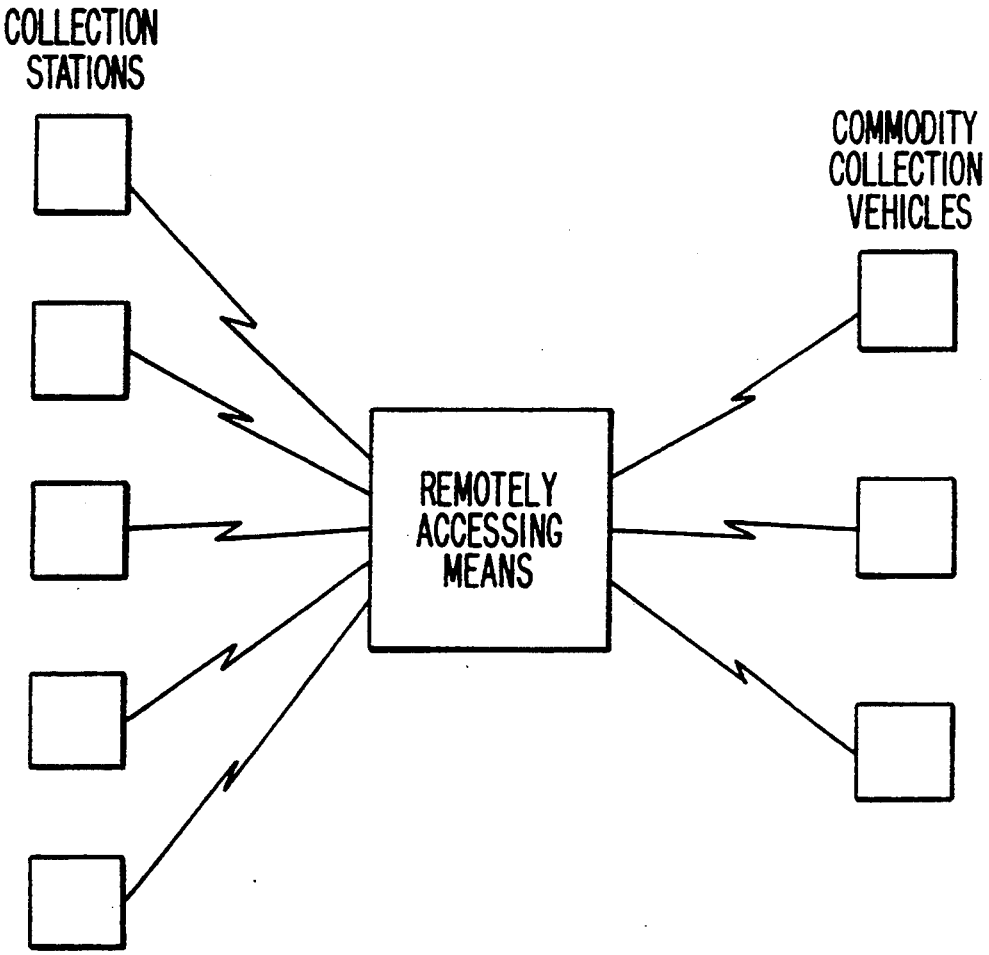
FIG. 13 is a block diagram schematically showing a plurality of collection stations, the remotely accessing means and the commodity collection vehicles of the present invention.

The plastic container machine 13 operates in substantially the same way as the glass machine 12, as shown in FIGS. 12A and 12B. In particular, the insertion sequence and the bar code reading are the same. Thereafter, there is no color recognition step necessary, and the machine goes directly to the shredding or densifying process (308). If the storage bin 32 is full, the machine shuts down (312, 313). However, FIG. 12B shows that the voucher may be issued for the plastic container even if the machine is out of service (314). This same option can be used with the other machines, if desired.

As is evident from the above, the system of the present invention provides for efficient and advantageous commodity collection and storage. The system minimizes the need for manual efforts in removing and storing densified commodities. In addition, it improves the visual appearance of the machines by allowing removal of the bulk storage from the immediate vicinity of the machines to a remote position which may be masked from the consumer's view. The use of printed coupons or vouchers eliminates time consuming resupply of coinage or currency. Failure or inoperative time may also be minimized by utilizing the remotely accessible microprocessor to communicate data on the machine operation state. In addition, data on the status of the commodity storage bins may be remotely accessed in order to efficiently route the commodity collection vehicles to the collection stations where the storage bins are full or near full.

As a result, the burden on retailers to manually sort containers, store containers and supply machines with coinage is greatly reduced. Also, the system allows a retailer to maintain a pleasant appearance within a retail outlet.

The mobile commodity collection and storage vehicle provides an efficient mechanism to remove densified or undensified commodities to a recycling center, while maintaining proper segregation of the commodities. Storage compartments may be placed under vacuum, or left at atmospheric pressure, as desired by the operator. Furthermore, the storage compartments can be unloaded quickly and efficiently.

Additional advantages and modifications will readily occur to those skilled in the art. The invention in its broader aspects is therefore not limited to the specific details, representative apparatus and illustrative examples shown and described.

Accordingly, departures may be made from such details without departing from the spirit or scope of the general inventive concept defined by the appended claims and their equivalents.

What is claimed is:

1. A method of collecting a plurality of commodities comprising the steps of:

densifying each of the plurality of commodities into a plurality of densified materials;

transferring at least one of the plurality of densified materials under vacuum via a hose to at least one of a plurality of segregated storage compartments on a mobile multi-compartment storage vehicle by using a vacuum source on the mobile storage vehicle to draw vacuum on the at least one segregated storage compartment on the mobile storage vehicle; and controlling a plurality of vacuum valves to place the at least one segregated storage compartment under vacuum, while other storage compartments are not under vacuum.

2. The method of claim 1, wherein the step of densifying the commodities is performed in a reverse vending machine.

3. The method of claim 1, wherein the step of densifying the plurality of commodities includes densifying a plurality of commodities composed of different materials into a plurality of different densified materials.

4. The method of claim 3, wherein the step of collecting includes collecting each of the plurality of different densified materials in a respective segregated temporary storage bin.

5. The method of claim 3, wherein the step of transferring includes transferring each of the plurality of different densified materials into a respective segregated storage compartment on the mobile storage vehicle.

6. The method of claim 1, wherein the vacuum source can be disconnected from the at least one storage compartment.

7. The method of claim 1, wherein the step of densifying the plurality of commodities includes densifying recyclable beverage containers.

8. The method of claim 7, wherein said beverage containers include containers composed of glass.

9. The method of claim 7, wherein said beverage containers include containers composed of aluminum.

10. The method of claim 7, wherein said beverage containers include containers composed of plastic.

11. The method of claim 1, further including a step of transporting the densified materials on the mobile storage vehicle to another storage location.

12. A method of collecting a plurality of commodities comprising the steps of:

densifying each of the plurality of commodities into a plurality of densified materials;

collecting the plurality of densified materials into at least one of a plurality of segregated temporary storage bins;

transferring at least one of the plurality of densified materials under vacuum via a hose to at least one of a plurality of segregated storage compartments on a mobile multi-compartment storage vehicle by using a vacuum source on the mobile storage vehicle to draw vacuum on the at least one segregated storage compartment on the mobile storage vehicle; and controlling a plurality of vacuum valves to place the at least one segregated storage compartment under vacuum, while other storage compartments are not under vacuum.

13. The method of claim 12, wherein each vacuum valve is disposed between the vacuum source and a corresponding segregated storage compartment.

14. The method of claim 13, wherein a plurality of manifolds are provided on the mobile storage vehicle, each vacuum valve communicating with the corresponding segregated storage compartment via a corresponding manifold.

15. The method of claim 1, wherein each vacuum valve is disposed between the vacuum source and a corresponding segregated storage compartment.

16. The method of claim 15, wherein a plurality of manifolds are provided on the mobile storage vehicle, each vacuum valve communicating with the corresponding segregated storage compartment via a corresponding manifold.

* * * * *